US010870138B2

(12) United States Patent
Moretto et al.

(10) Patent No.: US 10,870,138 B2
(45) Date of Patent: Dec. 22, 2020

(54) HOT ROLLING METHOD

(71) Applicant: ArcelorMittal, Luxembourg (LU)

(72) Inventors: Christian Moretto, Saint Nicolas en Foret (FR); Nicolas Pethe, Liverdun (FR); Audrey Couturier, Granges (FR)

(73) Assignee: ArcelorMittal, Luxembourg (LU)

( * ) Notice: Subject to any disclaimer, the term of this patent is extended or adjusted under 35 U.S.C. 154(b) by 201 days.

(21) Appl. No.: 15/108,132

(22) PCT Filed: Dec. 24, 2013

(86) PCT No.: PCT/IB2013/002865
§ 371 (c)(1),
(2) Date: Jun. 24, 2016

(87) PCT Pub. No.: WO2015/097488
PCT Pub. Date: Jul. 2, 2015

(65) Prior Publication Data
US 2016/0318080 A1 Nov. 3, 2016

(51) Int. Cl.
*B21B 1/22* (2006.01)
*B21B 37/00* (2006.01)
(Continued)

(52) U.S. Cl.
CPC ..... *B21B 1/22* (2013.01); *B21B 37/00* (2013.01); *B21B 27/10* (2013.01);
(Continued)

(58) Field of Classification Search
CPC ... B21B 2001/225; B21B 27/10; B21B 37/00; B21B 37/46; B21B 37/48; B21B 37/58;
(Continued)

(56) References Cited

U.S. PATENT DOCUMENTS 3,605,473 A 9/1971 Lockwood et al.
4,030,326 A * 6/1977 Morooka ..... B21B 37/165 700/155
(Continued)

FOREIGN PATENT DOCUMENTS

CN 1188793 A 7/1998
CN 1214280 A 4/1999
(Continued)

OTHER PUBLICATIONS

Translation of JP 60-015010, Jan. 25, 1985.*
(Continued)

*Primary Examiner* — Edward T Tolan
(74) *Attorney, Agent, or Firm* — Davidson, Davidson & Kappel, LLC

(57) ABSTRACT

A method for the regulation of at least one of the parameters (α) of a hot rolling process of a semi-finished metal product in at least one rolling mill stand having at least two work rolls is provided. The regulation method includes calculating a forward slip ratio (FWS) with the following equation:

$$FWS = \frac{|v_{exit} - v_{stand}|}{v_{stand}}$$

where $v_{exit}$ is the speed of the semi-finished product at the exit of the respective stand and $v_{stand}$ is the linear velocity of the work rolls; calculating an estimated coefficient of friction ($\mu_{real}$) as a function of a measured value of the screw-down force (F) of the work rolls in the stand and of the forward slip ratio (FWS); and regulating at least one of the parameters (α) based on the calculated estimated coefficient of friction ($\mu_{real}$).

15 Claims, 5 Drawing Sheets

(51) Int. Cl.
*B21B 27/10* (2006.01)
*B21B 45/02* (2006.01)

(52) U.S. Cl.
CPC ..... *B21B 45/0251* (2013.01); *B21B 2001/225* (2013.01); *B21B 2265/12* (2013.01); *B21B 2265/20* (2013.01); *B21B 2275/04* (2013.01); *B21B 2275/06* (2013.01)

(58) Field of Classification Search
CPC ..... B21B 38/06; B21B 38/08; B21B 45/0251; B21B 2265/20; B21B 2275/06; B21B 1/22; B21B 37/16; B21B 2265/12; B21B 2275/04
See application file for complete search history.

(56) References Cited

U.S. PATENT DOCUMENTS

| | | | | | |
|---|---|---|---|---|---|
| 4,691,547 | A * | 9/1987 | Teoh | B21B 37/66 | 72/10.7 |
| 5,799,526 | A * | 9/1998 | Mieze | B21B 37/66 | 72/11.4 |
| 6,014,881 | A * | 1/2000 | Imanari | B21B 37/32 | 72/201 |
| 6,089,069 | A | 7/2000 | Seidel et al. | | |
| 6,286,348 | B1 * | 9/2001 | Sekiguchi | B21B 37/66 | 72/10.3 |
| 6,286,354 | B1 * | 9/2001 | Kajiwara | B21B 13/023 | 72/237 |
| 8,601,851 | B2 * | 12/2013 | Seidel | C21D 8/0226 | 72/200 |
| 2002/0121118 | A1 * | 9/2002 | Nishiura | B21B 27/10 | 72/43 |
| 2009/0235706 | A1 * | 9/2009 | Broussard | B21B 37/16 | 72/10.1 |
| 2010/0089505 | A1 * | 4/2010 | Fukushima | C21D 8/02 | 148/645 |
| 2012/0216924 | A1 * | 8/2012 | Ota | B21B 37/76 | 148/511 |
| 2012/0324971 | A1 * | 12/2012 | Simaan | B21B 37/50 | 72/7.4 |
| 2013/0186156 | A1 | 7/2013 | Richter et al. | | |

FOREIGN PATENT DOCUMENTS

| | | | | | |
|---|---|---|---|---|---|
| CN | 1458867 | A | | 11/2003 | |
| DE | 10249923 | A1 | * | 5/2004 | B21B 38/06 |
| EP | 12749445 | A1 | | 1/2003 | |
| EP | 1829623 | A1 | | 9/2007 | |
| JP | 57-88911 | A | * | 6/1982 | B21B 37/08 |
| JP | 57-199501 | A | * | 12/1982 | B21B 37/00 |
| JP | S6015010 | A | | 1/1985 | |
| JP | S60223601 | A | | 11/1985 | |
| JP | 61-103613 | A | * | 5/1986 | B21B 37/12 |
| JP | H01156410 | A | | 6/1989 | |
| JP | H03151106 | A | | 6/1991 | |
| JP | H05337527 | A | | 12/1993 | |
| JP | H0739916 | A | | 2/1995 | |
| JP | H09206809 | A | | 8/1997 | |
| JP | H1156410 | A | | 3/1999 | |
| JP | 2000094024 | A | | 4/2000 | |
| JP | 2001321809 | A | | 11/2001 | |
| JP | 2005146094 | A | | 6/2005 | |
| JP | 2008264828 | A | | 11/2008 | |
| JP | 2012218051 | A | | 11/2012 | |
| KR | 20120074600 | A | | 7/2012 | |
| RU | 2177847 | C1 | | 1/2002 | |
| RU | 2009127090 | A | | 1/2011 | |

OTHER PUBLICATIONS

Translation, JP 57-199501A, Dec. 1982.*
E.Orowan, "The calculation of roll pressure in hot and cold flat rolling", Proceedings of the Institute of Mechanical Engineers, (194306), vol. 150, No. 1, pp. 140-167.
R.B. Sims, "The calculation of roll force and torque in hot rolling mills", Proceedings of the Institute of Mechanical Engineers, (195406), vol. 168, No. 1, pp. 191-200.
D.R. Bland; H. Ford, "The Calculation -of Roll Force and Torque in Cold Strip Rolling with Tensions", Proceedings of the Institute of Mechanical Engineers, (194806), vol. 149, p. 144.

* cited by examiner

HOT ROLLING METHOD

This invention relates to the hot rolling of metallurgical products. More specifically it relates to a method for the regulation of at least one parameter of the hot rolling process.

BACKGROUND

The following text takes as an example the hot rolling of steel strip, although the invention is applicable to the hot rolling of other metallurgical products, in particular aluminum or its alloys.

Hot rolled steel strip is conventionally fabricated according to the method described below:

- continuous casting of a slab having a thickness ranging from 200 to 260 mm;
- reheating of the slab to a temperature of approximately 1100-1200° C.;
- passage of the slab through a roughing mill comprising a single reversible stand or a plurality of independent stands (e.g. five) arranged in a line one after another, to obtain a strip having a thickness of approximately 30 to 50 mm;
- passage of the strip through a finishing mill comprising a plurality of stands (e.g. six or seven) in which the strip is present simultaneously, to give it a thickness of approximately 1.5 to 10 mm, followed by the coiling of the strip.

The hot rolled strip thus obtained can then be subjected to heat or mechanical treatments that will give it its definitive properties, or it can undergo a cold rolling that will further reduce its thickness before the performance of the final heat or mechanical treatments.

During the hot rolling of steel strips, in each stand of the finishing line, the steel strip is subjected to a precisely determined sequence of thermal and mechanical operations (reduction, temperature) which is influenced by the friction between the work rolls and the strip in the gap between the rolls. This sequence of operations has a major influence on the quality of the strip (surface appearance and metallurgical properties).

It is therefore of primary importance to be able to measure and control the friction in the roll gap. Too high a coefficient of friction leads to excessive energy consumption and a rapid deterioration of the rolls, as well as to surface defects on the strip. Conversely, too low a coefficient of friction causes slippage problems and problems with the guidance of the strip as well as problems of threading the strip in the stand.

Regulation of the coefficient of friction is assured, in particular, by the lubrication process.

Currently, the lubrication is generally carried out at the level of each stand of the rolling mill by the injection of an emulsion composed of water and a lubricating fluid, conventionally oil, on the roll at the level of the gap. See, for example, U.S. Pat. No. 3,605,473.

The need to have effective lubrication is even greater with the rolling of the new VHS (Very High Strength, generally between 450 and 900 MPa) or UHS (Ultra High Strength, generally greater than 900 MPa) grades of steel and/or new formats, for example strip thicknesses less than 3 mm. These steels, such as USIBOR® or Dual Phase steels are naturally harder and require the application of a greater rolling force, which reduces the capacity of the rolling mill. These steels can also have a surface composition with less calamine, which conventionally acts as the first lubrication element.

In current rolling methods, moreover, to avoid the risk of non-threading of the strip in the roll gap as the result of a coefficient of friction being too high, the injection of lubricating emulsion is deactivated during the rolling of the beginning of the strip. In the same manner, to prevent the next strip from failing to thread properly on account of the presence of lubricating emulsion on the rolls, the injection of lubricating emulsion is deactivated during the rolling of the tail end of the previous strip. These two sections, which are therefore rolled without lubricant, must be scrapped because they do not have the required thickness, which represents a waste of several meters of strip (from 5 to 10 meters of strip per stand) and therefore a significant loss in terms of productivity.

Numerous solutions have been proposed to ensure effective lubrication and consequently to regulate the coefficient of friction to prevent rolling incidents such as slippage or failure of the strip to thread properly.

JP-A-2008264828 describes a hot rolling method in which the work rolls are covered with a coating having a specific composition to guarantee a certain value of the coefficient of friction.

JP-A-2005146094 describes a hot rolling method in which the strip is prevented from slipping by using a lubricating oil having a particular composition.

However, these solutions do not make it possible to continuously regulate the coefficient of friction during rolling. The coefficient of friction is a function of, among other things, the type of material constituting the strip to be rolled, the condition of the work rolls (roughness, deterioration, scale etc.), the rolling speed and the percentage of reduction to be achieved. In addition, the effectiveness of the lubrication can be very different between the beginning and the end of a run, and even from one line to another and from one stand to another on the same line. However, neither of the proposed solutions makes it possible to take variations of these parameters into account during the process.

JPH-A-1156410 describes a method in which the squeezing force applied by the rolling mill rolls is measured by a sensor, and then the quantity of lubrication oil injected is adjusted so that the measured rolling force is equal to a target value.

BRIEF SUMMARY

An objective of this solution is to adjust the coefficient of friction during the process, but does not take into consideration all of the parameters that govern the coefficient of friction, which makes it less effective. Moreover, this solution entails significant risks of instability during the rolling process, such as variations of speed or traction if a large quantity of lubricant is to be added to achieve the required force.

The present invention provides a rolling method in which the coefficient of friction is regulated reliably and effectively during production to prevent rolling incidents and to achieve an optimum output. The purpose of the invention is also preferably to provide a method that reduces the instabilities of the rolling process and makes it possible to lubricate the strip over its entire length.

The present invention provides a method for the regulation of at least one of the parameters ($\alpha$) of a hot rolling process of a semi-finished metal product in at least one rolling mill stand comprising at least two work rolls, wherein the regulation method comprises the following steps:

the calculation of a forward slip ratio (FWS) by means of the following equation:

$$FWS = \frac{|v_{exit} - v_{stand}|}{v_{stand}}$$

where $v_{exit}$ is the speed of the semi-finished product at the exit of the respective stand and $v_{stand}$ is the linear velocity of the work rolls;

the calculation of an estimated coefficient of friction ($\mu_{real}$) as a function of a measured value of the screwdown force (F) of said work rolls in the stand and of the forward slip ratio (FWS) calculated previously; and the regulation of at least one of the parameters ($\alpha$) based on the calculated estimated coefficient of friction ($\mu_{real}$).

The present invention further provides a method for hot rolling a semi-finished metal product in at least one rolling mill stand comprising at least two work rolls in which at least one of the parameters a of the method is regulated by means of a regulation method according to any one of the preceding claims.

A hot rolling mill for performing the methods of the present invention is also provided.

The present invention additionally provides a computer program product comprising software instructions which, when they are implemented by a computer, carry out a regulation method in accordance with the present invention.

BRIEF DESCRIPTION OF THE DRAWINGS

Other characteristics and advantages of the invention will become apparent from a reading of the following description.

To illustrate the invention, tests have been conducted and will be described by way of non-restricting examples, in particular with reference to the accompanying drawings, in which:

FIG. 1 shows a metallic strip B in the process of being rolled in a rolling mill comprising two stands 1, 2 in which the strip B is engaged simultaneously, for example a finishing mill for the hot rolling of steel strip. Rolling mills of this type generally comprise 5, 6 or 7 stands. Each of the stands 1, 2 conventionally comprises two work rolls 1*a*, 1*a*' and 2*a*, 2*a*' and two backup rolls 1*b*, 1*b*' and 2*b*, 2*b*'. Each stand is activated by a pair of motors $C_1$, $C_2$ (not shown). The distance between the two work rolls, respectively 1*a*-1*a*' and 2*a*-2*a*' is called the gap S (not shown) and is regulated by means of screwdown mechanisms 7.

Figure 1:
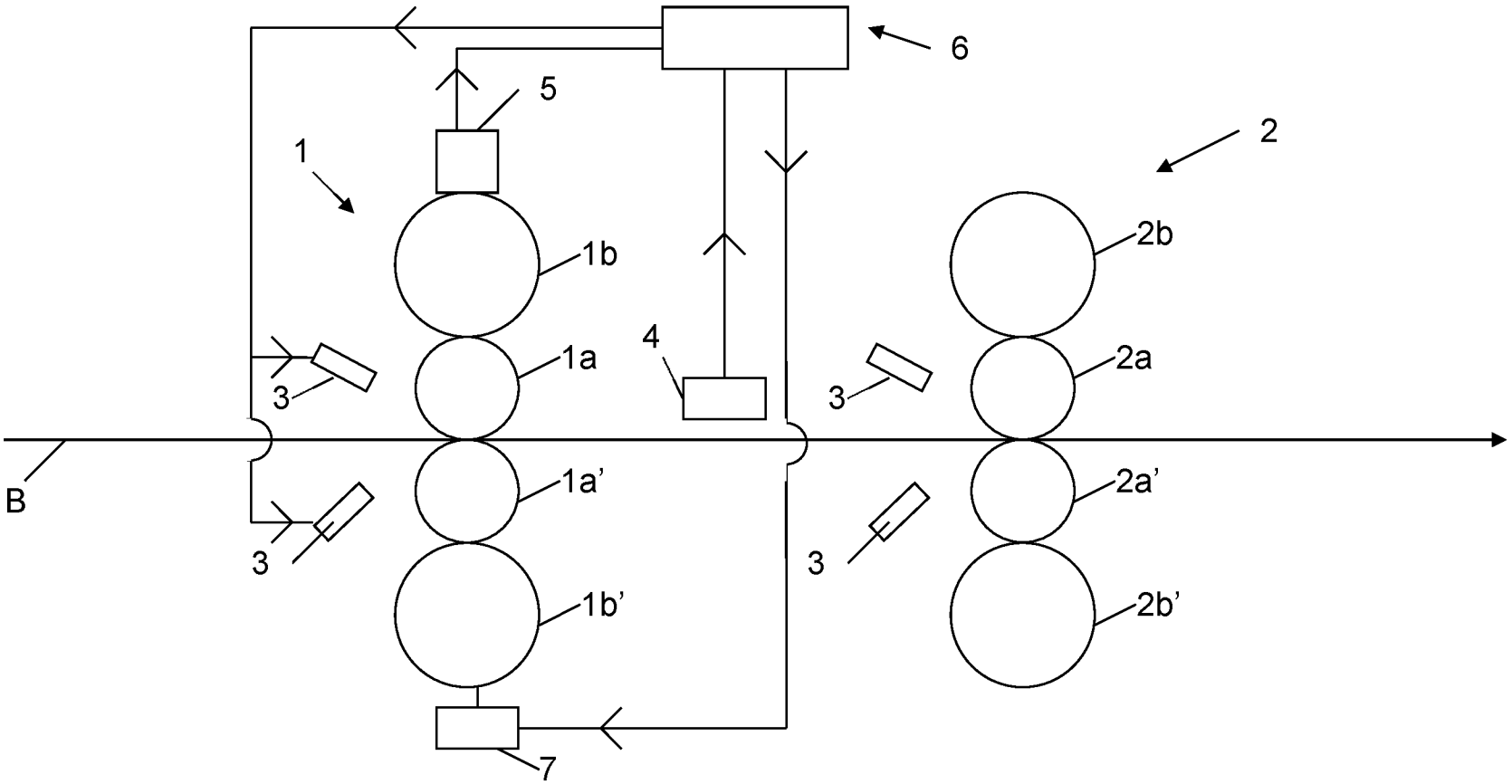
FIG. 1 shows a two-stand rolling mill equipped with one embodiment of a regulation device according to the invention.

The rolls are lubricated at the level of each of the stands by an injection device 3 such as, for example, spray nozzles that make it possible to spray an oil and water emulsion.

According to one embodiment of the invention, a speed measurement device 4 is located at the exit from the first stand in the direction of travel of the strip, this device 4 making it possible to measure the speed of the strip as it exits the stand $v_{exit}$. This device may be, by way of example, an optical measurement device such as a laser velocimeter. This speed measurement makes it possible to calculate in real time the FWS (ForWard Slip) ratio on the basis of the following formula:

$$FWS = \frac{|v_{exit} - v_{stand}|}{v_{stand}} \quad \text{(Formula 1)}$$

where:

$v_{exit}$ is the speed of the strip at the exit from the stand, for example measured by means of the device 4.

$v_{stand}$ is the linear velocity of the work rolls calculated according to the following formula:

$$v_{stand} = \omega R \quad \text{(Formula 2)}$$

where R is the radius of the work roll and $\omega$ the angular velocity of the work rolls measured, for example, by an impulse generator.

The velocities $v_{exit}$ and $v_{stand}$ can be expressed in any unit of velocity, although they must both be expressed in this same unit. Likewise, the unit in which the angular velocity $\omega$ is expressed must be consistent with the unit in which $v_{stand}$ is expressed.

Also according to one embodiment of the invention, a force measurement device 5 that makes it possible to measure the screwdown force F of the work rolls in real time is also provided at the level of each stand. These devices, which are well known to a person skilled in the art, can be, for example, strain gauges installed on the uprights of the stand or under the screwdown mechanism 7.

The measured data of the screwdown force F and the speed of the strip at the exit $v_{exit}$ are transmitted to a processing unit 6 which can then, as a function of these measurements and other previously recorded parameters, send settings, for example, to the lubricant emulsion injection nozzles 3 or to the screwdown mechanism 7.

Figure 3:
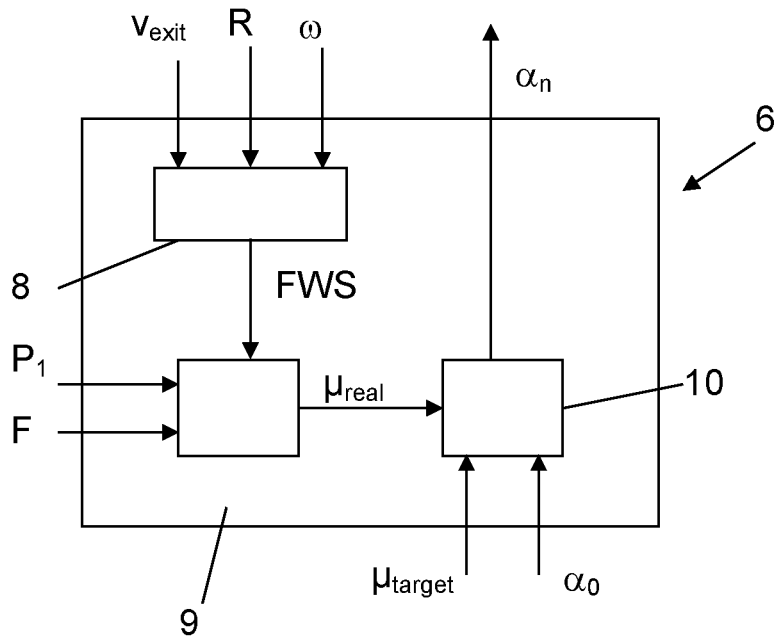
FIG. 3 shows a control diagram according to a first embodiment of the invention.

A processing unit 6 that makes it possible to implement one embodiment of the regulation method according to the invention is described below with reference to FIG. 3.

The speed of the strip at the exit from the stand $v_{exit}$ and the angular velocity of the work rolls $\omega$ are measured in line and their values are sent to a first computer 8. This first computer 8 comprises at least one internal memory where the value of the radius R of the work rolls is stored, which makes it possible to calculate the linear velocity of the work rolls $v_{stand}$ and then the value of the forward slip ratio FWS according to formula 1.

The calculated value FWS is then transmitted to a second computer 9 that also receives as input data the value of the screwdown force F measured in real time by the sensor 5. This second computer comprises at least one internal memory where the parameters $P_1$ are stored. These parameters $P_1$ are a function of the model selected for the calculation of the coefficient of friction $\mu_{real}$.

Different simplified models can be adapted to obtain the calculation of the coefficient of friction $\mu_{real}$ from the values of the forward slip FWS and the screwdown force F. These models are known in their general outlines but not in their particular application as described in the invention.

By way of example, we will describe below the utilization for purposes of the invention of the Orowan model, as well as of other models known to a person skilled in the art, such as the SIMS or Bland & Ford models. The general theory of each of these three models is described, for example, in "The calculation of roll pressure in hot and cold flat rolling," E. Orowan, Proceedings of the Institute of Mechanical Engineers, June 1943, Vol. 150, No. 1, pp. 140-167 for the Orowan model, "The calculation of roll force and torque in hot rolling mills," R. B. Sims, Proceedings of the Institute of Mechanical Engineers, June 1954, Vol. 168, No. 1, pp. 191-200 for the Sims model, "The Calculation of Roll Force and Torque in Cold Strip Rolling with Tensions," D. R. Bland and H. Ford, Proceedings of the Institute of Mechanical Engineers, June 1948, Vol. 149, p. 144, for the Bland & Ford model.

Figure 2:
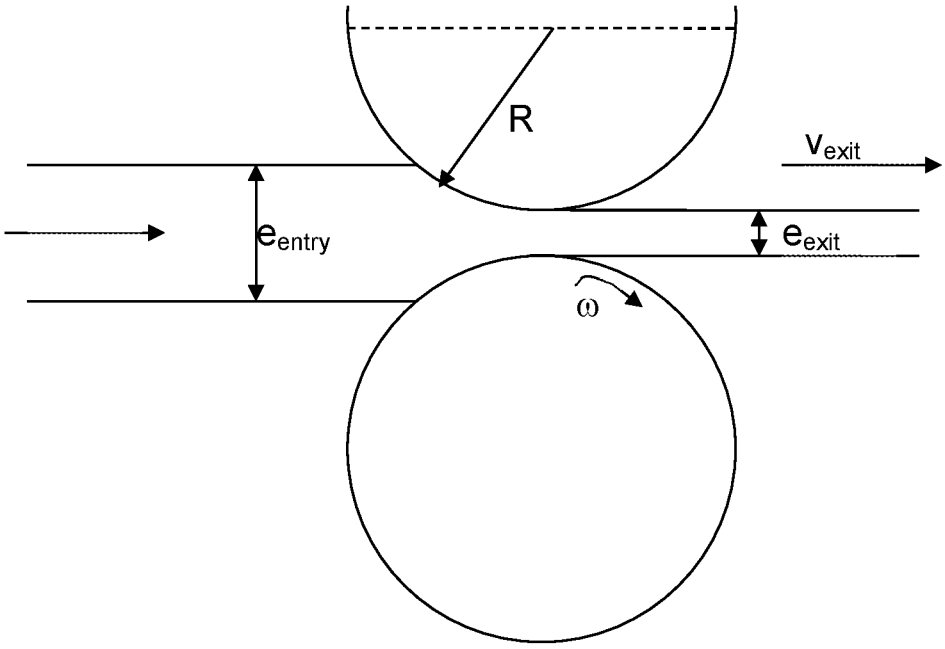
FIG. 2 shows the different variables utilized in one embodiment of a regulation method according to the invention.

To calculate the coefficient of friction $\mu_{real}$ in real time using the Orowan model, the parameters $P_1$ are the entry thickness $e_{entry}$ and exit thickness $e_{exit}$ of the strip, the entry tension $\sigma_{entry}$ and the exit tension $\sigma_{exit}$ of the strip, wherein in this example these parameters are set at the beginning of rolling but can also be estimated or measured in real time. These parameters are illustrated in FIG. 2.

On the basis of this data, the second computer 9 also calculates the coefficient of friction $\mu_{real}$, which data is transmitted to a processor 10. The calculation time of $\mu_{real}$ is less than or equal to 100 ms and preferably less than or equal to 50 ms.

The input data of the processor 10 are $\mu_{real}$, a target value of the coefficient of friction $\mu_{target}$ determined on the basis of charts or modeling, as a function of the grade of steel of the rolled strip, the number of kilometers of strip rolled on the installation under consideration, the wear of the rolls, the type of oil used, etc., as well as a parameter $\alpha_0$. This parameter is the initial value of the process parameter $\alpha$ that will be used to regulate the coefficient of friction $\mu_{real}$.

This parameter can be, by way of example, the injection flow $Q_{oil}$ of the lubricant oil. The initial value can be determined, for example, by means of charts or by modeling.

The value of the coefficient of friction $\mu_{real}$ is then compared to the target value of the coefficient of friction $\mu_{target}$. If the absolute value of the difference between these two values $|\mu_{target}-\mu_{real}|$ is greater than a predetermined value $\Delta$, a new value of the parameter $\alpha_n$ is then calculated and applied so that the value of the calculated coefficient of friction $\mu_{real}$ is brought to a value closer to the target value $\mu_{target}$, the purpose of which is to prevent failure of the strip to thread properly and to prevent slip if $\mu_{real}<\mu_{target}+\Delta$ or premature wear of the work rolls and surface defects if it is not. For example, the injection flow $Q_{oil}$ of the lubricating oil can be reduced or increased. It is preferable to keep the flow of water in the emulsion constant for thermal considerations of cooling of the roll and proper operation to ensure that the injected emulsion covers a large part of the roll.

The time that elapses between the measurement of the exit speed of the strip $v_{exit}$ and the receipt of the setting an is less than or equal to 500 ms, and preferably less than or equal to 150 ms.

This succession of measurements, calculations and regulations can also be repeated until the end of the rolling of the strip under consideration and until the end of the rolling run.

Figure 4:
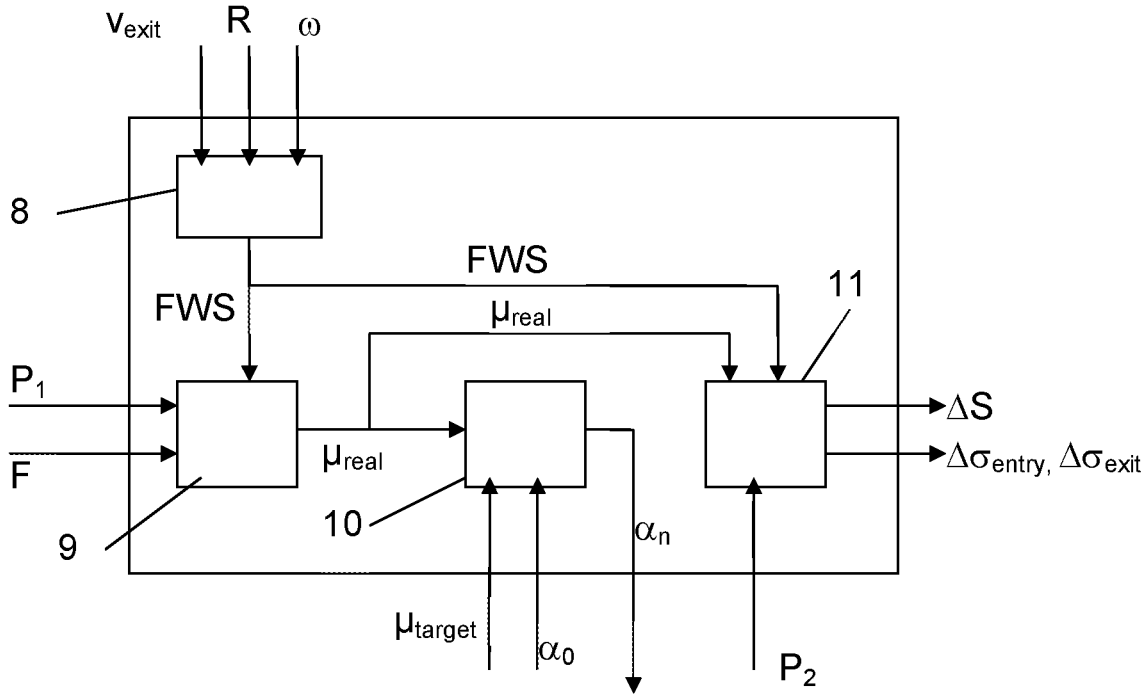
FIG. 4 shows a control diagram according to a second embodiment of the invention.

FIG. 4 shows a control diagram according to a second embodiment of the invention.

The difference from the first embodiment described above and illustrated in FIG. 3 is that the values FWS and $\mu_{real}$ calculated by the computers 8 and 9 respectively are transmitted to a second processor 11. The input data of this second processor are therefore FWS, $\mu_{real}$ as well as a set of parameters $P_2$. These parameters $P_2$ are a function of the model selected for the calculation of the coefficient of friction $\mu_{real}$.

If we use the Orowan model as in the previous embodiment, the parameters $P_2$ are the entry thickness $e_{entry}$ and exit thickness $e_{exit}$ of the strip, the entry tension $\sigma_{entry}$ and the exit tension $\sigma_{exit}$ of the strip, the radius R of the rolls, wherein in this example, these parameters are set at the beginning of rolling, but may also be estimated or measured in real time. $P_2$ also includes the modulus of deformation M of the rolling mill stand under consideration. This modulus, which is generally expressed in t/mm, characterizes the elastic deformation of the stand linked to the rolling force.

On the basis of this data, the processor calculates, for example, the value of the rolling force F' that must be applied to obtain the thickness $e_{exit}$.

The new value of the parameter $\alpha$ can cause modifications to other parameters and can therefore create problems such as, for example, an under-thickness at the exit from the stand.

Figure 5:
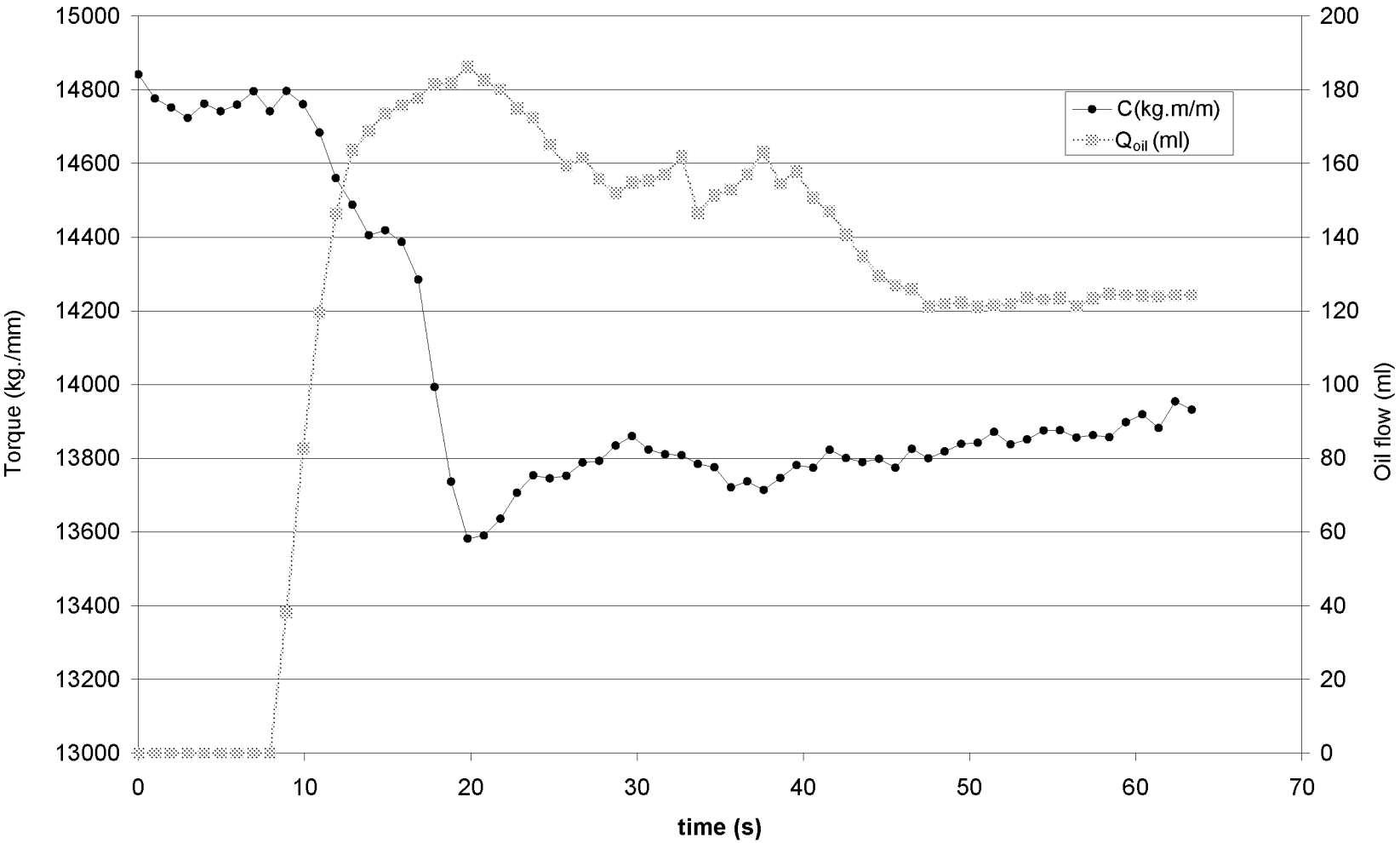
FIG. 5 shows the start of the injection of oil and the motor torque as a function of time during a test utilizing a regulation method according to the invention.

If the injected oil flow $Q_{oil}$ is modified, the coefficient of friction $\mu_{real}$ is modified, and consequently the force F applied by the roll on the strip. That is in turn translated by a modification of the thickness $e_{exit}$ of the strip at the exit from the stand, as illustrated in FIG. 5. It is therefore possible to obtain unsatisfactory thicknesses at the exit from the stand. If this problem occurs, the same model as the one used to calculate $\mu_{real}$ can then be used, but in the reverse direction. In this case of the Orowan model, the parameters of entry thickness $e_{entry}$, $e_{exit}$, tension $\sigma_{entry}$, $\sigma_{exit}$, diameter D, the target coefficient of friction $\mu_{target}$, and the calculated forward slip ratio are input to thereby obtain the force F' to be applied to the strip, and the necessary variation of the gap $\Delta S$ according to formula 3 below, and the positions of the screwdown mechanism 7 that define the gap are consequently modified.

$$\Delta S \equiv \frac{F' - F}{M} \qquad \text{(Formula 3)}$$

where:

F' is the value of the rolling force calculated by the processor 11.

F is the value of the rolling force measured by the sensor 5.

M is the modulus of deformation of the stand under consideration.

The units of these three variables must be consistent among themselves and can be, for example, Newtons for the forces F and F', and N/mm for the modulus of deformation M.

This same calculation principle by inverse model can be used to control other parameters of the rolling process such as the tensions upstream and downstream of the stand $\sigma_{entry}$, $\sigma_{exit}$ to prevent disruptions of the speed of the strip at the exit from rolling.

The processing units described above with reference to FIGS. 3 and 4 contain different elements such as calculators or processors, but it is also possible to envisage one and the same processor that makes it possible to perform the different calculation and setpoint operations, or any other possible configuration that makes possible the calculation and setpoint steps.

Test

A hot rolling method according to the invention was carried out with a DWI (Drawn and Wall Ironed) steel strip, wherein the lubrication oil used was a standard commercially available oil.

Figure 6:
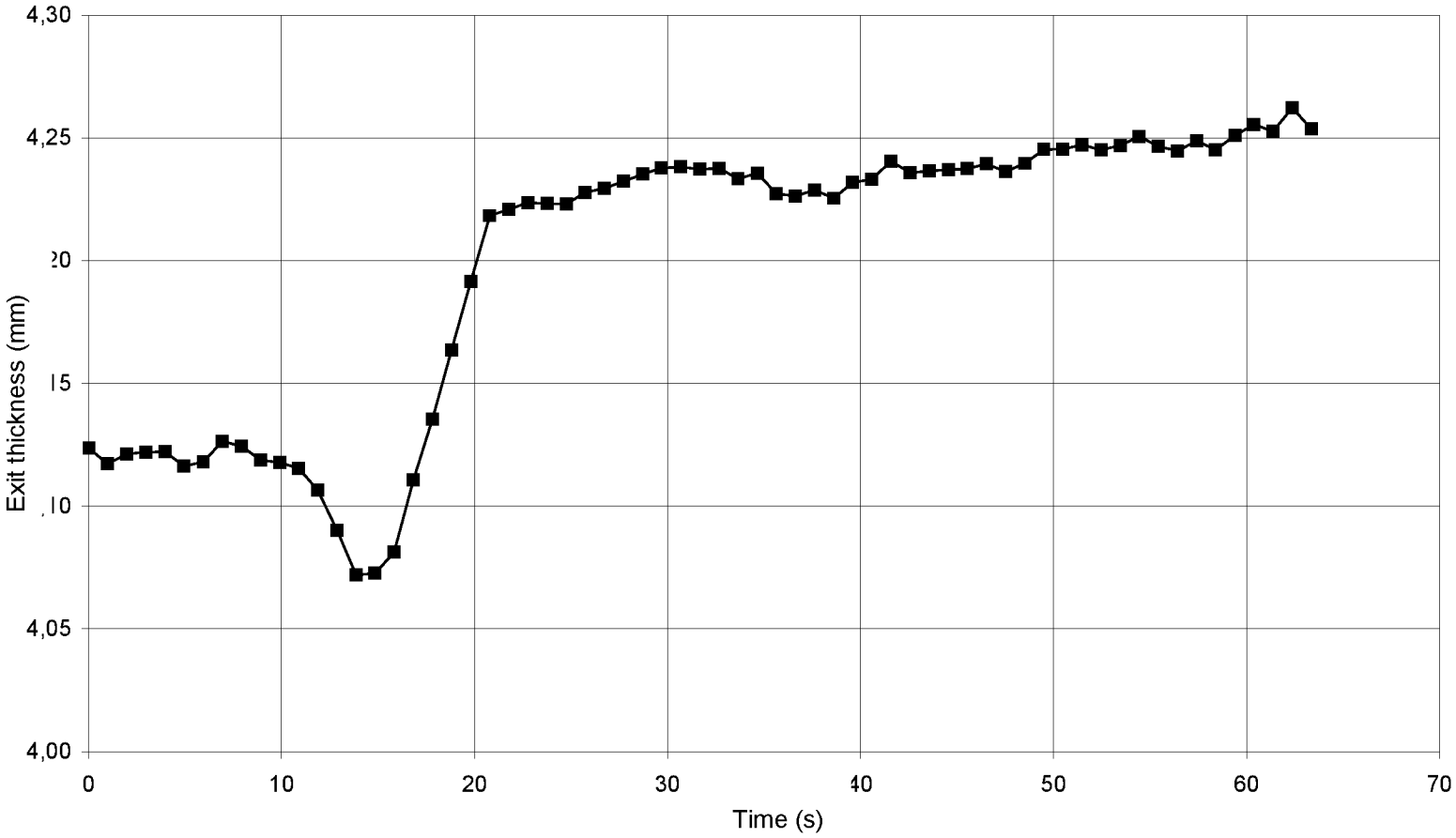
FIG. 6 shows the thickness of the rolled strip at the exit from the stand as a function of time during a test utilizing a regulation method according to the invention.

The results are illustrated in FIGS. 5 and 6.

As illustrated in FIG. 5, the injection flow $Q_{oil}$ is zero during the rolling of the head end of the strip. That is a deliberate choice, because this test was devoted principally to the lubrication of the tail of the strip.

On the other hand, it can be seen that the oil injection flow $Q_{oil}$ was regulated until the end of rolling of the strip, which means that the tail end of the strip was also rolled in the presence of lubricant, which was not the case in the prior art.

FIG. 6 presents the thickness of the strip at the stand exit $e_{exit}$ as a function of the rolling time. It will be noted that there is a drop in this thickness $e_{exit}$ after 10 seconds; this drop corresponds to what was explained above. The modification of the injected oil flow $Q_{oil}$ results in a modification of the applied force F, and in this case in a major reduction of the thickness $e_{exit}$ of the strip as it exits the stand. Thanks to the regulation illustrated in FIG. 4, a new screwdown force F' is calculated and the gap S modified as a consequence to obtain an exit thickness $e_{exit}$ that meets the expectations of the customer. The increase and maintenance of the thickness $e_{exit}$ are visible in this FIG. 6.

Neither forward slip nor any misthreading of the next strip occurred during this test, which means that the coefficient of friction was regulated reliably and effectively. Moreover, it was possible to roll the end of the strip in the presence of lubricant without any effect on the rolling of the next strip.

The invention claimed is:

1. A method for the regulation of at least one parameter ($\alpha$) of a hot rolling process of a semi-finished metal product in at least one rolling mill stand having at least two work rolls, the regulation method comprises the steps of:

calculating a forward slip ratio (FWS) by means of the following equation:

$$FWS = \frac{|v_{exit} - v_{stand}|}{v_{stand}}$$

where $v_{exit}$ is a speed of the semi-finished product at an exit of a respective stand and $v_{stand}$ is a linear velocity of two work rolls;

calculating an estimated coefficient of friction ($\mu_{real}$) as a function of a measured value of a screwdown force (F) of the two work rolls in the stand and of the forward slip ratio (FWS) calculated previously; and regulating the at least one parameter ($\alpha$) based on the calculated estimated coefficient of friction ($\mu_{real}$); and wherein during the step of calculating the estimated coefficient of friction ($\mu_{real}$), a target value of the coefficient of friction ($\mu_{target}$) is predetermined, and the coefficient of friction ($\mu_{real}$) is calculated in real time;

during the regulating step, when $|\mu_{target}-\mu_{real}|$ is greater than a predetermined value ($\Delta$), the corresponding at least one parameter ($\alpha$) is adjusted so that $|\mu_{target}-\mu_{real}|$ becomes less than or equal to the predetermined value ($\Delta$).

2. The regulation method according to claim 1, further comprising, before the calculation of the forward slip ratio, the step of:

measuring a speed of the semi-finished product at the exit ($v_{exit}$) from the stand, a time between the measurement of ($v_{exit}$) and the calculation of the coefficient of friction ($\mu_{real}$) being less than or equal to 100 ms.

3. The regulation method according to claim 2, wherein the time between the measurement of $v_{exit}$ and the calculation of $\mu_{real}$ is less than or equal to 50 ms.

4. The regulation method according claim 1, wherein the time between the measurement of $v_{exit}$ and the regulation of the at least one parameter ($\alpha$) is less than or equal to 500 ms.

5. The regulation method according to claim 1, further comprising, subsequent to the step of the regulation of the at least one parameter ($\alpha$), a correction step comprising:

regulating the screwdown force F as a function of the calculated values of the forward slip ratio (FWS) and of the coefficient of friction ($\mu_{real}$).

6. The regulation method according to claim 1, further comprising, subsequent to the step of the regulation of at least one parameter ($\alpha$), a tension correction step comprising:

regulating an entry tension ($\sigma_{entry}$) and an exit tension ($\sigma_{exit}$) of the strip as a function of the calculated values of the forward slip ratio (FWS) and of the coefficient of friction ($\mu_{real}$).

7. A method for hot rolling a semi-finished metal product in at least one rolling mill stand having at least two work rolls comprising the step of:

hot rolling a semi-finished metal product in at least one rolling mill stand having at least two work rolls; and regulating the at least one parameter ($\alpha$) according to regulation method of claim 1.

8. The rolling method according to claim 7, wherein a lubricating emulsion composed of oil and water is injected at a level of a gap between the two work rolls and wherein the at least one parameter ($\alpha$) is an injection flow of the oil ($Q_{oil}$).

9. The rolling method according to claim 7, wherein the rolled metal semi-finished product is an aluminum strip.

10. The rolling method according to claim 7, wherein the rolled metal semi-finished product is a steel strip.

11. The rolling method according to claim 10, wherein the rolled steel strip is a Very High Strength or Ultra High Strength steel strip.

12. The rolling method according to claim 10, wherein the rolled steel strip has a thickness at the end of rolling of 3 mm or less.

13. A hot rolling mill comprising:

at least one rolling mill stand having at least two work rolls;

a processing unit configured to regulate the at least one parameter according to the regulating step of claim 7.

14. The hot rolling mill according to claim 13, further comprising:

a laser velocimeter for measuring the speed of the semi-finished product $v_{exit}$ at the exit from the rolling mill stand.

15. Computer readable media, having stored thereon, computer executable instructions for performing a method comprising the regulation method of claim 1.

* * * * *